US008821249B2

(12) United States Patent
Gomez

(10) Patent No.: US 8,821,249 B2
(45) Date of Patent: Sep. 2, 2014

(54) GAMING MACHINE WITH MULTIPLE SELECTION GROUPS

(75) Inventor: Benjamin T. Gomez, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 1332 days.

(21) Appl. No.: 12/083,882

(22) PCT Filed: Oct. 20, 2006

(86) PCT No.: PCT/US2006/041129

§ 371 (c)(1),
(2), (4) Date: Apr. 21, 2008

(87) PCT Pub. No.: WO2007/047977

PCT Pub. Date: Apr. 26, 2007

(65) Prior Publication Data

US 2009/0093291 A1 Apr. 9, 2009

Related U.S. Application Data

(60) Provisional application No. 60/728,891, filed on Oct. 21, 2005.

(51) Int. Cl.
*A63F 9/24* (2006.01)
*G07F 17/32* (2006.01)

(52) U.S. Cl.
CPC ..... *G07F 17/32* (2013.01); *G07F 17/3262* (2013.01)
USPC ..... 463/20; 463/16; 463/17; 463/1; 463/19; 463/25

(58) Field of Classification Search
USPC ..... 463/16–20, 25
See application file for complete search history.

(56) References Cited

U.S. PATENT DOCUMENTS

| | | | | |
|---|---|---|---|---|
| 6,033,307 | A | 3/2000 | Vancura | |
| 6,439,995 | B1 * | 8/2002 | Hughs-Baird et al. | 463/20 |
| 2002/0187827 | A1 * | 12/2002 | Blankstein | 463/20 |
| 2004/0018873 | A1 * | 1/2004 | Hughs-Baird et al. | 463/20 |
| 2005/0054404 | A1 * | 3/2005 | Baerlocher | 463/9 |
| 2005/0054433 | A1 * | 3/2005 | Iwamoto | 463/25 |
| 2005/0059456 | A1 * | 3/2005 | Mead et al. | 463/16 |
| 2006/0025205 | A1 * | 2/2006 | Casey et al. | 463/20 |
| 2006/0116188 | A1 * | 6/2006 | Blankstein | 463/16 |
| 2009/0093291 | A1 | 4/2009 | Gomez | |

OTHER PUBLICATIONS

PCT International Search Report for International Application No. PCT/US06/41129, dated Feb. 5, 2007 (1 page).

* cited by examiner

*Primary Examiner* — Steve Rowland
(74) *Attorney, Agent, or Firm* — Nixon Peabody LLP

(57) ABSTRACT

A gaming system for conducting a wagering game comprising a value input device for receiving a wager, a display for displaying a plurality of selection groups, and a processor coupled to the display. Each selection group includes a plurality of selectable elements. The processor is operative to alternately select the elements in the selection groups until encountering an end-feature condition, and provide awards associated with the selected elements.

14 Claims, 7 Drawing Sheets

GAMING MACHINE WITH MULTIPLE SELECTION GROUPS

CROSS REFERENCE TO RELATED APPLICATIONS

This application is a U.S. national phase of International Application No. PCT/US2006/041129, filed Oct. 20, 2006, which claims the benefit of priority of U.S. Provisional Patent Application No. 60/728,891, filed Oct. 21, 2005, both of which are incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine having multiple selection groups.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to an aspect of the present invention, a gaming system for conducting a wagering game comprises a value input device for receiving a wager, a display for displaying a plurality of selection groups, and a processor coupled to the display. Each selection group includes a plurality of selectable elements. The processor is operative to alternately select the elements in the selection groups until encountering an end-feature condition, and provide awards associated with the selected elements.

Additional aspects of the invention will be apparent to those of ordinary skill in the art in view of the detailed description of various embodiments, which is made with reference to the drawings, a brief description of which is provided below.

DETAILED DESCRIPTION

Figure 1:
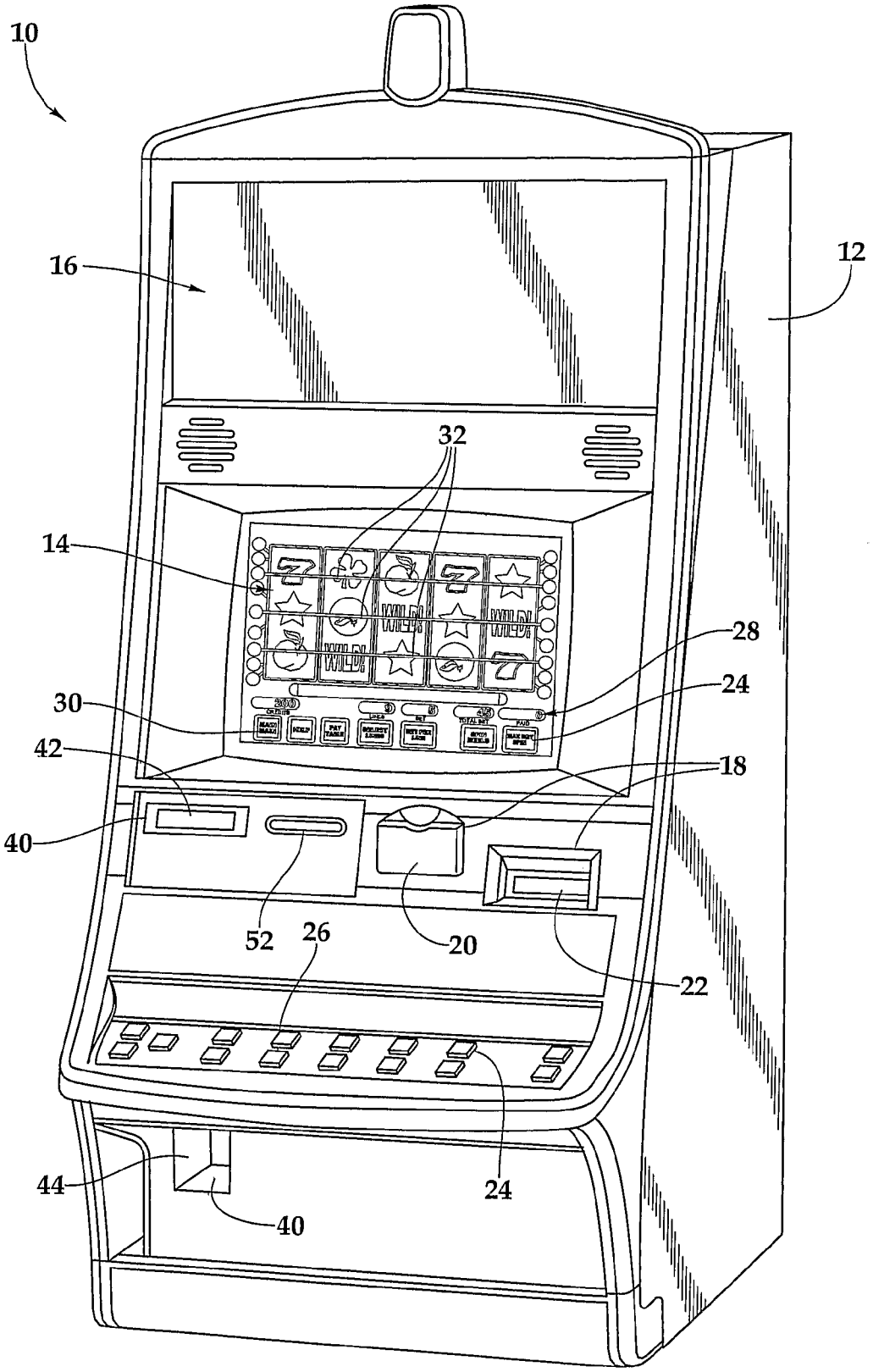
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
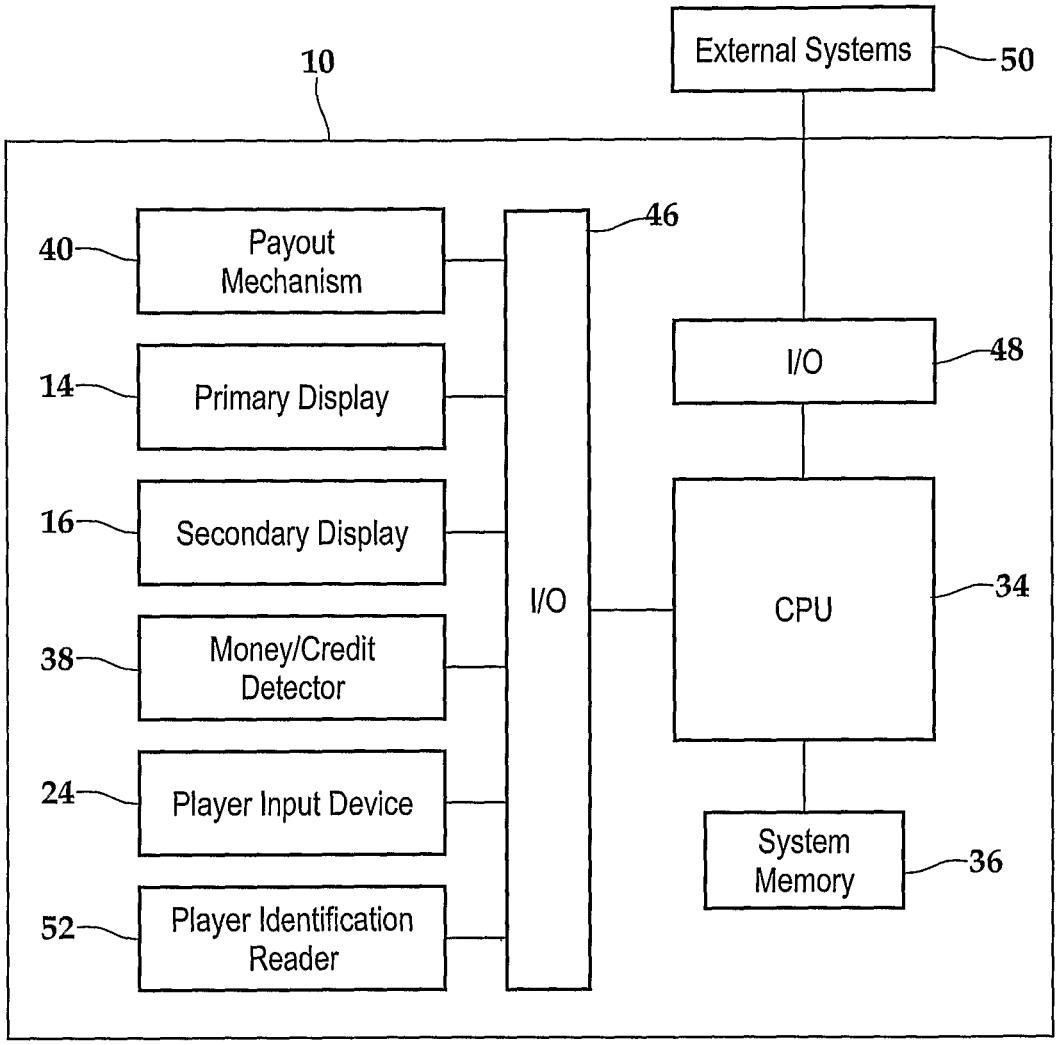
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
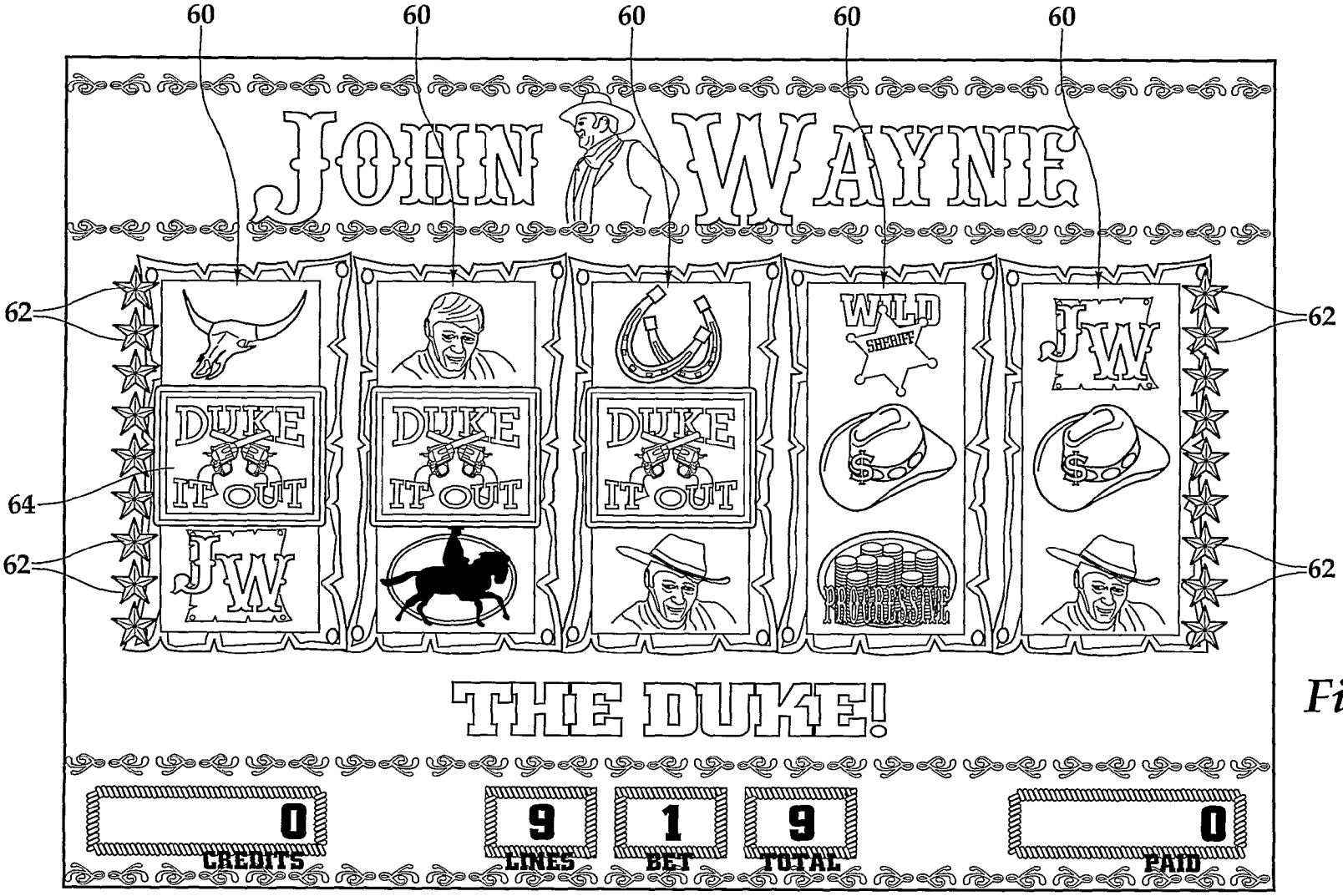
FIG. 3 is a display image associated with a basic wagering game conducted on the gaming machine and including a start-bonus outcome for triggering a bonus game.

Turning now to FIG. 3, in one embodiment the basic game is a slot game including a plurality of symbol-bearing reels 60 that, in response to a wager, are rotated and stopped to place symbols on the reels in visual association with a number of paylines. Although the paylines themselves are not shown in FIG. 3, each payline may, for example, pass through a single symbol on each reel 60 as generally shown in FIG. 1. The leftmost and rightmost ends of the various paylines are denoted by end markers 62, which may be color-coded to help distinguish the paylines from each other. The reels 60 may be electromechanical or simulated. If the reels 60 are electromechanical, the various graphics adjacent the reels may be printed on a reel glass or displayed on a superimposed video image positioned in front of the reels. A superimposed video image may, for example, be implemented with a display arrangement of the type disclosed in U.S. Pat. No. 6,517,433, which is incorporated herein by reference in its entirety.

A combination of three DUKE IT OUT symbols 64 along an active payline triggers a bonus game shown in the display images of FIGS. 4 through 7. The display depicts a first group of selectable elements 66 (see FIG. 4) represented by revolvers and a second group of selectable element 68 (see FIG. 5) represented by bad guys. The selectable elements 66 are randomly associated with respective first awards preferably in the form of credit awards. The selectable elements 68 are randomly associated with respective second awards preferably in the form of award modifiers such as multipliers that multiply the credit awards as described below. The first and second awards are initially concealed from view but are revealed upon selection of the associated element. If the display is outfitted with a touch screen, an element may, for example, be selected by touching the display at the location of the element. One or more of the elements in either the first group of elements 66 or the second group of elements 68 is randomly associated with an end-feature outcome (i.e., "stopper") that either terminates the bonus game entirely or causes the bonus game to proceed to another feature. The number of elements associated with an end-feature outcome may be fixed (e.g., always one) or randomly determined. In one embodiment, only elements in the second group of elements 68 may be associated with an end-feature outcome.

The bonus game includes a plurality of possible rounds. In each round, the player is prompted to alternately select elements from the first and second groups 66, 68. Each selected element reveals the award associated therewith. The player first selects an element 66 from the first group to reveal an associated credit award and then selects an element 68 from the second group to reveal an associated multiplier that multiplies this credit award. The multiplied credit award for the current round is added to a bonus meter 70, which shows the total bonus award thus far accumulated in all rounds of the bonus game. The player advances to the next round and repeats the process of alternately selecting elements 66, 68 from the first and second groups, respectively, until an end-feature outcome is revealed during the current round. Upon revealing the end-feature outcome, the CPU provides the player with the total bonus award in the bonus meter 70 and shifts operation from the bonus game back to the basic game.

Figure 4:
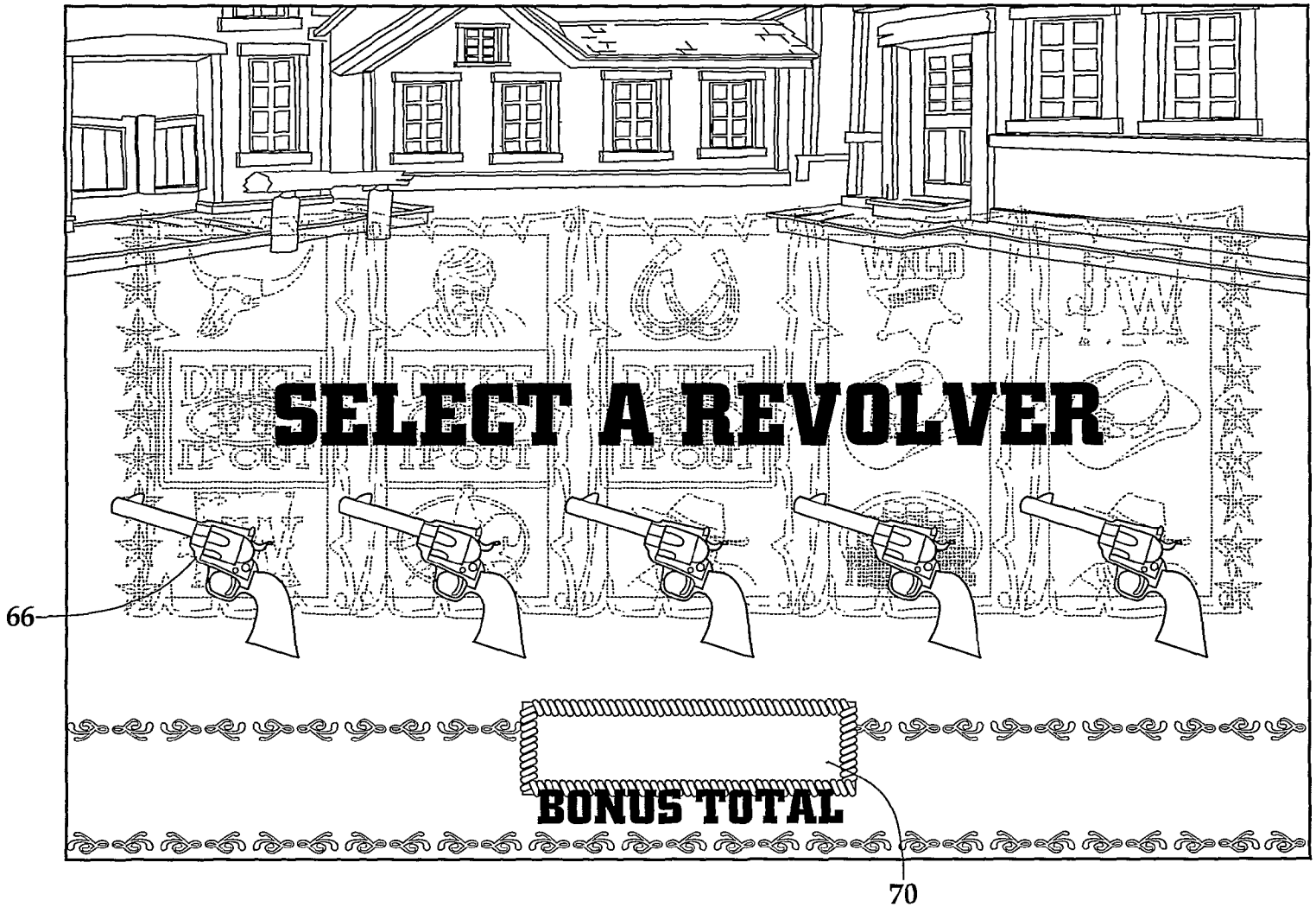
FIGS. 4-7 are display images associated with the bonus game.
Figure 5:
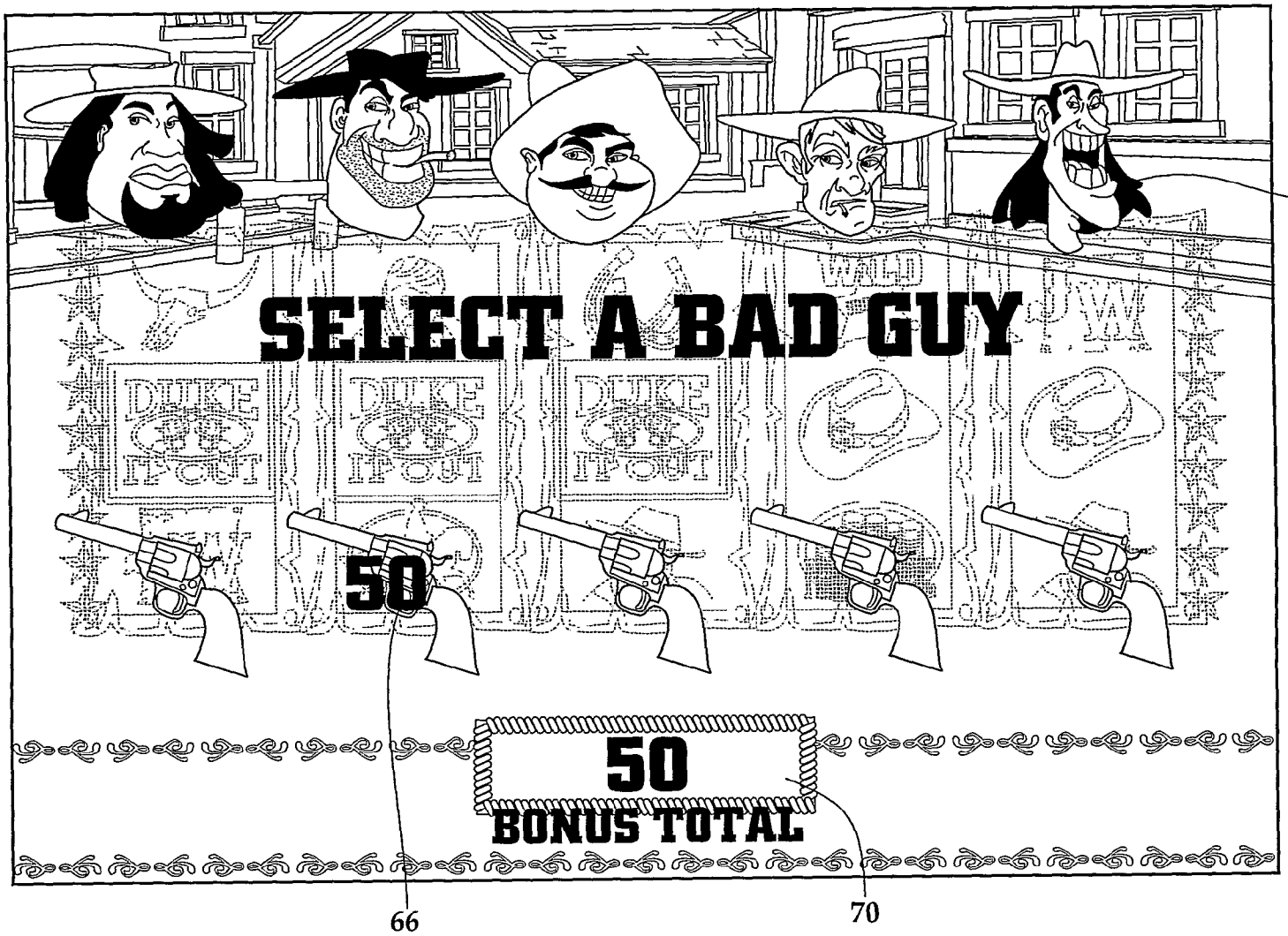
Figure 6:
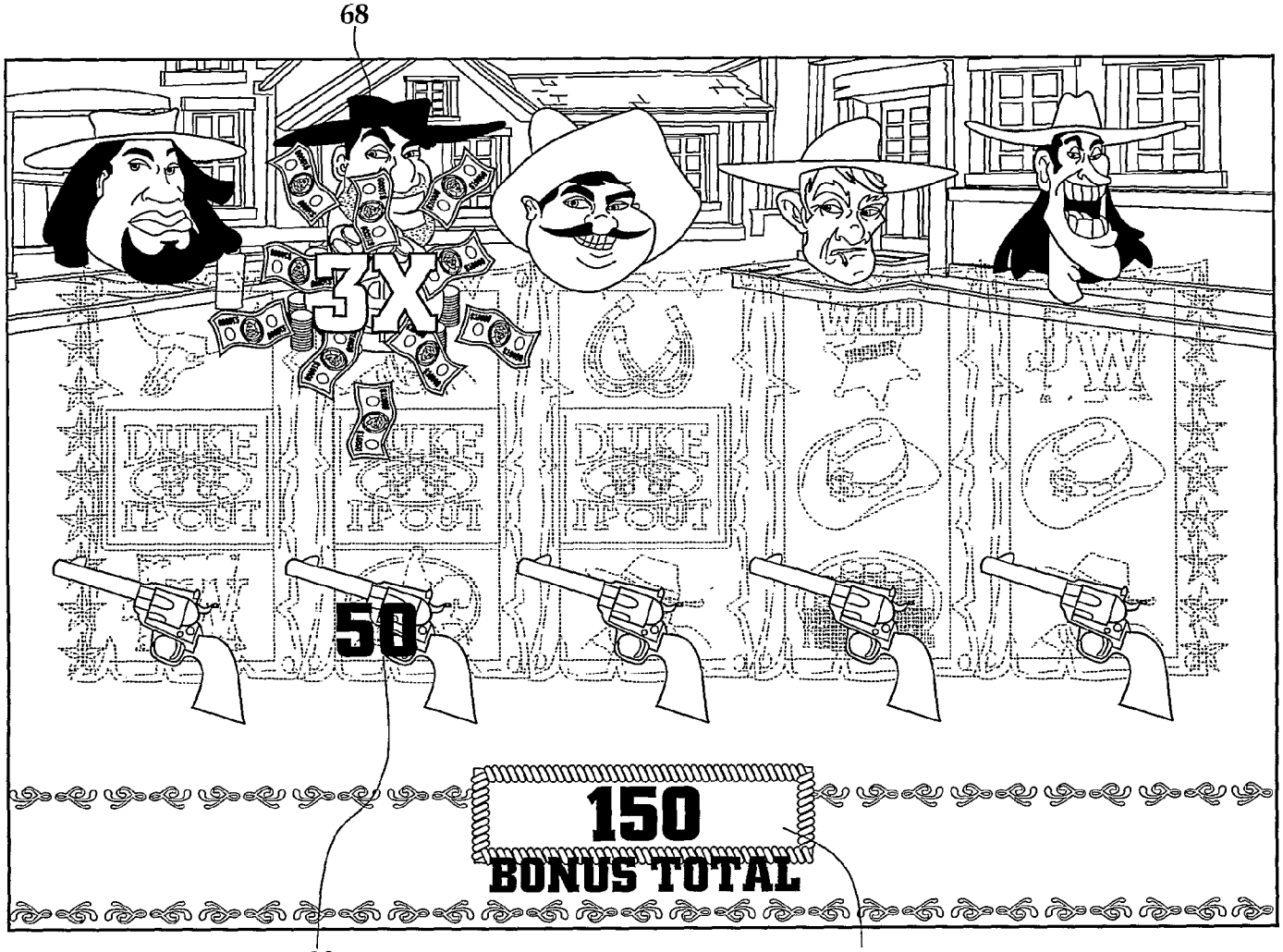

FIGS. 4 through 7 provide an illustrated example of the bonus game. Referring to FIG. 4, upon triggering the bonus game, the player enters an initial round of the bonus game. In the initial round, the player is prompted to first select an element from the first group of elements 66 represented by revolvers. Referring to FIG. 5, after selecting one of the elements 66, the selected element reveals its associated credit award. In the illustrated example, the selected element 66 reveals a credit award of 50 credits. After selecting one of the elements 66, the player is prompted to select an element from a second group of selected elements 68 represented by bad guys. Referring to FIG. 6, after selecting one of the elements 68, the selected element reveals its associated multiplier. In the illustrated example, the selected element 68 reveals a 3× multiplier. The revealed multiplier multiplies the credit award associated with the element 66 selected in the initial round. In the illustrated example, the 3× multiplier multiplies the credit award of 50 credits to yield a multiplied credit award in the initial round of 150 credits. The multiplied credit award of 150 credits for the current round is added to a bonus meter 70.

Figure 7:
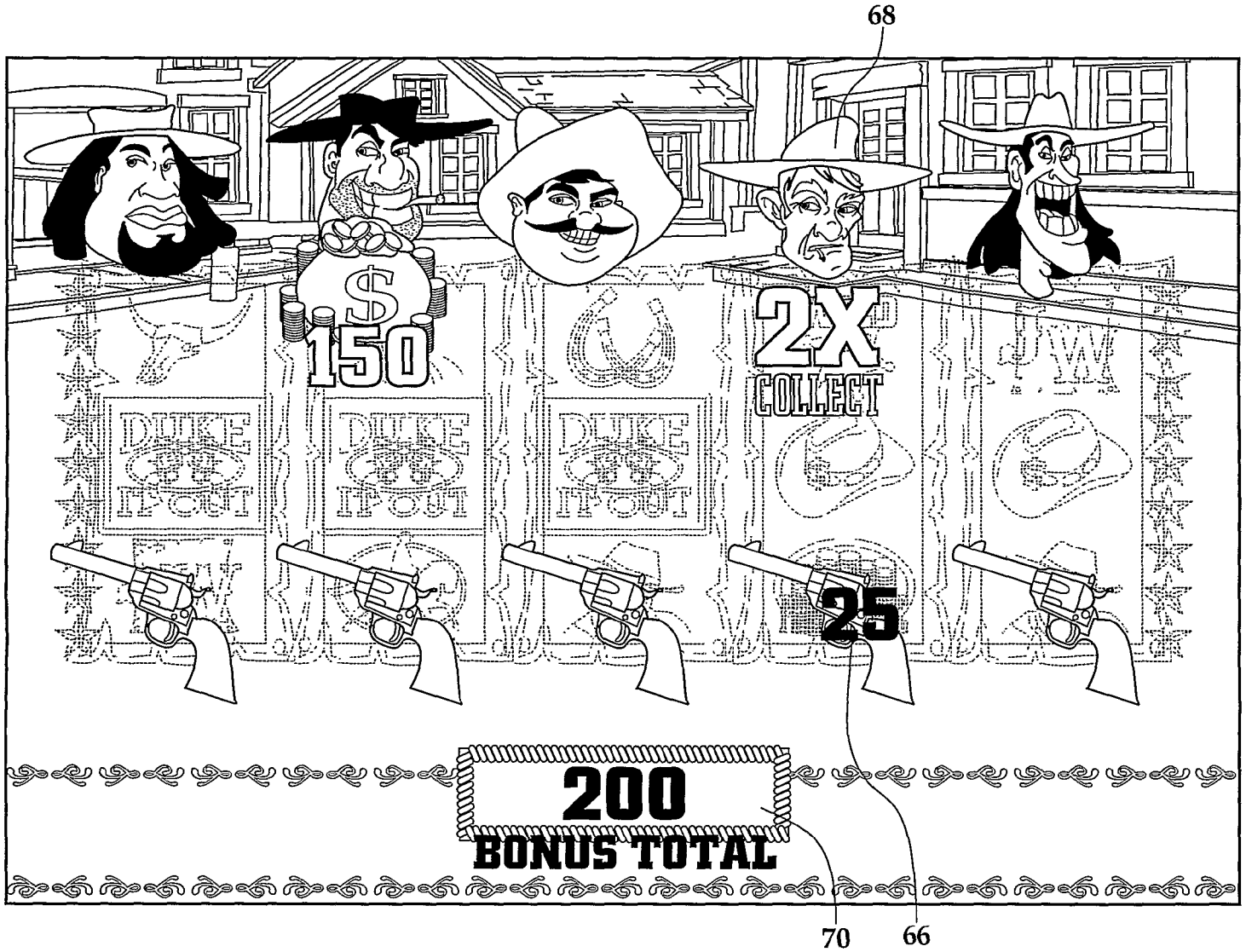

Because the initial round did not reveal an end-feature outcome, the player advances to the next round (i.e., second round) of the bonus game. Referring to FIG. 7, the player then alternately selects one of the previously unselected elements 66 to reveal a credit amount of 25 credits and one of the previously unselected elements 68 to reveal a 2× multiplier. The revealed multiplier multiplies the credit award associated with the element 66 selected in the second round. In the illustrated example, the 2× multiplier multiplies the credit award of 25 credits to yield a multiplied credit award in the second round of 50 credits. The multiplied credit award of 50 credits for the current round is added to a bonus meter 70 to yield an accumulated bonus amount of 200 credits representing the amounts won in the initial and second rounds.

In the illustrated example, the player's selection of one of the elements 68 in the second round not only reveals a 2× multiplier, but also reveals an end-feature outcome denoted by a COLLECT indicium adjacent to the 2× multiplier. Upon revealing this end-feature outcome, the CPU provides the player with the total bonus award of 200 credits in the bonus meter 70 and shifts operation from the bonus game back to the basic reel game. If the end-feature outcome had not been revealed with the 2× multiplier, the player would have advanced to a third round of the bonus game and again alternately selected elements 66, 68 from the first and second groups, respectively.

The bonus game ends upon the occurrence of an end-feature condition. In the illustrated embodiment, the end-feature condition results from the appearance of end-feature indicium (e.g., COLLECT) associated with a selected element. In another embodiment, the end-feature condition results from the appearance of related indicia (or unrelated indicia) associated with multiple selected elements. For example, some of the elements 66 in the first group may be associated with indicia having a predetermined relationship (e.g. identical or similar appearance) with the indicia associated with some of the elements 68 in the second group. The game may be designed such that the player alternately selects the elements 66, 68 from round to round until the selected elements in the current round do not have a matching or other predetermined relationship. Alternatively, the game may be designed such that the player alternately selects the elements 66, 68 from round to round until the selected elements in the current round have a matching or other predetermined relationship. In another embodiment, the end-feature condition results from the number of selections reaching a predetermined limit, i.e., the player makes a predetermined number of selections in the bonus game.

In another alternative embodiment, the selected elements reveal other types of awards such as additional picks, advancement to another bonus feature, free plays, winning all the awards in one of the selection groups, etc.

Each of these embodiments and obvious variations thereof is contemplated as falling within the spirit and scope of the claimed invention, which is set forth in the following claims.

What is claimed is:

1. A gaming system for conducting a wagering game, comprising:

a value input device for receiving a wager from a player;

a display for displaying a plurality of selection groups including first and second selection groups, wherein the first selection group includes a first plurality of player-selectable elements associated with respective different first awards, the first awards including credit amounts, and wherein the second selection group includes a second plurality of player-selectable elements associated with respective different second awards. the second awards including modifiers for modifying the credit amount; and a processor coupled to the display and:

allowing the player to alternately select a player-selectable element from each of the selection groups until encountering an end-feature condition, the alternative selections organized into a plurality of possible rounds, wherein the plurality of possible rounds includes a first round having an element selected from the first selection group associated with its respective first award, and an element selected from the second selection group associated with its respective second award immediately following the selection of the element from the first selection group, and a second round having another element selected from the first selection group associated with its respective first award, and another element selected from the second selection group associated with its respective second award immediately following the selection of the another element from the first selection group, providing a total award based at least on a first combination of the first award associated with the element from the first selection group and the second award associated with the element from the second selection group, and a second combination of the first award associated with the another element from the first selection group and the second award associated with another element from the second selection group; and wherein the first and second selection groups are visually separated from each other on the display and the first and second awards are initially concealed from view and are revealed upon selection of the associated elements from the first and second selection groups.

2. The system of claim 1, wherein the end-feature condition is the selection of a player-selectable element from one of the selection groups revealing an end-feature outcome.

3. The system of claim 1, wherein the processor conducts a basic game and a bonus game, the bonus game being triggered by a start-bonus outcome in the basic game, the processor being operative to alternately select the elements in the selection groups and provide the total award during the bonus game.

4. A method of conducting a wagering game on a gaming system, the method comprising:

receiving a wager from a player to play the wagering game via a value input device;

displaying a plurality of selection groups including first and second selection groups on a display, wherein the first selection group includes a first plurality of player-selectable elements, associated with respective different first awards the first awards including credit amounts, and wherein the second selection group includes a second plurality of player-selectable elements associated with respective different second awards, the second awards including modifiers for modifying the credit amounts;

configuring a controller to accept player input to alternately select an element from each selection group until encountering an end-feature condition, the alternative selections organized into a plurality of possible rounds, wherein the plurality of possible rounds includes a first round having an element selected from the first selection group associated with its respective first award, and an element selected from the second selection group associated with its respective second award immediately following the selection of the element from the first selection group, and a second round having another element selected from the first selection group associated with its respective first award, and another element selected from the second selection group associated with its respective second award immediately following the selection of the another element from the first selection group;

providing a total award based at least on a combination of the first award associated with the element from the first selection group and the second award associated with the element from the second selection group, and a second combination of the first award associated with the another element from the first selection group and the second award associated with another element from the second selection group; and wherein the first and second selection groups are visually separated from each other on the display and the first and second awards are initially concealed from view and are revealed upon selection of the associated elements from the first and second selection groups.

5. The method of claim 4, wherein the end-feature condition is the selection of a player-selectable element from one of the selection groups revealing an end-feature outcome.

6. The method of claim 4, further including conducting a basic game and a bonus game, the bonus game being triggered by a start-bonus outcome in the basic game, the bonus game including displaying selection groups, alternately selecting, and providing the total award.

7. A non-transitory computer readable storage medium encoded with instructions for directing a gaming system to perform the method of claim 4.

8. A gaming terminal for conducting a wagering game, comprising:

a value input device for receiving a wager from a player;

a display for displaying a first selection group and a second selection group, wherein the first selection group includes a first plurality of player-selectable elements associated with respective different first awards, the first awards including credit amounts, and wherein the second selection group includes a second plurality of player-selectable elements associated with respective different second awards, the second awards including modifiers for modifying the credit amounts; and a controller coupled to the display, the controller:

allowing the player to alternately select a player-selectable element from each of the selection groups until encountering an end-feature condition, the alternative selections organized into a plurality of possible rounds, wherein the plurality of possible rounds includes a first round having an element selected from the first selection group associated with its respective first award, and an element selected from the second selection group associated with its respective second award immediately following the selection of the element from the first selection group, and a second round having another element selected from the first selection group associated with its respective first award, and another element selected from the second selection group associated with its respective second award immediately following the selection of the another element from the first selection group, providing a total award based at least on a first combination of the first award associated with the element from the first selection group and the second award associated with the element from the second selection group , and a second combination of the first award associated with the another element from the first selection group and the second award associated with another element from the second selection group; and wherein the first and second selection groups are visually separated from each other on the display and the first and second awards are initially concealed from view and are revealed upon selection of the associated elements from the first and second selection groups.

9. The gaming terminal of claim 8, wherein the end-feature condition is the selection of a player-selectable element from one of the selection groups revealing an end-feature outcome.

10. The gaming terminal of claim 8, wherein the first and second awards are initially concealed from view and are revealed upon selection of the associated elements from the first and second selection groups.

11. The gaming terminal of claim 8, wherein the controller is operative to conduct a basic game and a bonus game, the bonus game being triggered by a start-bonus outcome in the basic game, the controller being operative to alternately select the elements in the selection groups and provide the total award during the bonus game.

12. The system of claim 1, wherein the processor provides the total award when the end condition is encountered.

13. The method of claim 4, wherein the controller provides the total award when the end condition is encountered.

14. The gaming terminal of claim 8, wherein the controller provides the total award when the end condition is encountered.

* * * * *